US005448962A

United States Patent [19]

Moody

[11] Patent Number: 5,448,962

[45] Date of Patent: Sep. 12, 1995

[54] TORPEDO TUBE SLIDE VALVE

[75] Inventor: Paul E. Moody, Barrington, R.I.

[73] Assignee: The United States of America as represented by the Secretary of the Navy, Washington, D.C.

[21] Appl. No.: 269,460

[22] Filed: Jun. 30, 1994

[51] Int. Cl.[6] ..... B63E 8/32

[52] U.S. Cl. ..... 114/238; 114/316; 251/343

[58] Field of Search ..... 114/238, 316–319; 89/5, 1.809; 251/145, 343, 347

[56] References Cited

U.S. PATENT DOCUMENTS

| | | | |
|---|---|---|---|
| 2,837,971 | 6/1958 | Wosak | 89/5 |
| 2,995,144 | 8/1961 | Manning et al. | 251/343 X |
| 4,848,210 | 7/1989 | Bissonnette | 114/238 X |
| 5,210,369 | 5/1993 | Cassidy | 89/1.81 |

*Primary Examiner*—Sherman Basinger

*Attorney, Agent, or Firm*—Michael J. McGowan; James M. Kasischke; Prithvi C. Lall

[57] ABSTRACT

A torpedo tube and slide valve assembly includes a torpedo tube having a plurality of circumferentially spaced slots therein and an impulse tank surrounding the torpedo tube wherein the slots provide a flow path between the impulse tank and the interior of the torpedo tube. A cylindrical slide valve is slidably received on the outer surface of the torpedo tube but inside the impulse tank. The slide valve is slidably movable inside the impulse tank between a first position wherein the slide valve covers the slots and a second position wherein the slots are uncovered. The impulse tank includes a cylindrical sleeve portion which extends in a breechward direction to accommodate movement of the slide valve within the impulse tank. Circumferential sealing gaskets are preferably secured on the outside surface of the torpedo tube at each end of the slots for providing spaced circumferential seals between the torpedo tube outer surface and the slide valve inner surface.

7 Claims, 3 Drawing Sheets

TORPEDO TUBE SLIDE VALVE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The instant invention relates to a slide valve assembly and more particularly to a slide valve for a torpedo tube.

2. Description of the Prior Art

A conventional torpedo tube launch system (FIG. 1) includes an impulse tank generally indicated at 10 which surrounds the torpedo tube generally indicated at 12 adjacent the breech end thereof. Impulse tank 10 is part of an ejection system that is operative for forcing water into torpedo tube 12 to eject a torpedo from torpedo tube 12. Water from impulse tank 10 enters torpedo tube 12 through a plurality of slots 14 formed in the wall of torpedo tube 12. In this connection, an internal cylindrical slide valve generally indicated at 16 is provided for closing slots 14 (See FIG. 1). Sealing gaskets 18 are provided on slide valve 16 and the inner surface of torpedo tube 12 to prevent water from entering torpedo tube 12 when the torpedo tube breech door (not shown) is open.

Torpedo tube 12 is constructed so that the inside diameter is approximately $1\frac{3}{4}$ inches larger in diameter than a standard 21 inch diameter torpedo. The increased diameter is utilized to accommodate longitudinal lands (not shown) which are installed 90 degrees apart on the horizontal and vertical centerlines of torpedo tube 12. In order to allow proper movement of a torpedo inside torpedo tube 12, the muzzle portion of tube 12 and the lands of tube 12 must be machined for smoothness. In addition, the entire inside portion of the breech end of torpedo tube 12 must also be machined to allow proper sliding of slide valve 16. The machined portion extends from the location where slide valve 16 is in its fully open position (bottom portion of FIG. 1) through the breech end the torpedo tube 12. The lands located in the breechward end of torpedo tube 12 are attached to the torpedo tube wall by means of machine screws instead of welding. This permits removal of slide valve 16 through the breech end of tube 12 for replacement of a gasket 18 or other repairs. Slide valve 16 includes a longitudinal guide slot 20 (FIG. 2) formed on the upper centerline thereof. Guide slot 20 is provided to accommodate a guide stud attached to the upper portion of a torpedo. Guide stud 20 is operative for holding the torpedo in proper axial position in torpedo tube 12 prior to firing, and is further operative for preventing the torpedo from rifling as the torpedo is loaded into or fired from torpedo tube 12. Guide slot 20 aligns with a slot in the upper land so that rotation or rifling of the torpedo is prevented along the entire length of torpedo tube 12. Metal grids 22 are positioned to cover slots 14. Additional slide valve grids 23 are disposed at one end of slide valve 16. Grids 22 and 23 are necessary as some torpedoes utilize communication wire/flexible hose systems to link a fired torpedo to the ship for command and control purposes. As the communication wire is payed out, grids 22 and 23 effectively prevent the wire from falling through slots 14 into impulse tank 10.

One particular problem with the present design is that guide slot 20 weakens the structural integrity of slide valve 16 by creating a localized stress concentration. The stress concentration is currently reduced by forming guide slot 20 with rounded corners, however this does not completely eliminate the stress concentration. It has been suggested to fashion slide valve 16 of stronger material, however this would not completely eliminate the stress concentration. It has also been suggested to enlarge the outer diameter of slide valve 16 so that slide valve 16 could have a greater thickness, however, this is not structurally or economically practical, nor does it eliminate the stress concentration.

It has also been found that the flow area from impulse tank 10 to torpedo tube 12 does not provide enough flow area to minimize unacceptable flow losses during system firing evolution. Resolution of this problem in the current design has been unsuccessful. Restriction of the flow path is caused by three factors: the size of slots 14; the axial movement of slide valve 16; and metal grates 22 and 23 which extend across slots 14. It has been found that widening of slots 14 is impossible without jeopardizing the structural integrity of torpedo tube 12. The length of flow slots 14 is approximately 17 inches, however, in referring to FIG. 1 it can be seen that the axial movement of slide valve 16 significantly blocks the opening limiting the flow area to approximately 12.5 inches (See lower half of FIG. 1). Limitation of axial movement of slide valve 16 is primarily due to large shoulder brackets 24 necessary to connect external power cylinders 26 to internal slide valve 16. Grids 22 and 23 further reduce the flow area by approximately 21% and cause turbulent flow between impulse tank 10 and the interior of torpedo tube 12.

SUMMARY OF THE INVENTION

Accordingly, it is an object of the instant invention to provide a torpedo tube slide valve which increases the flow area between the impulse tank and the interior of the torpedo tube.

It is another object to preserve access to the slide valve to allow maintenance of the slide valve.

It is still another object to increase slide valve movement and minimize slide valve weakness.

The instant invention provides a torpedo tube and slide valve assembly which eliminates the problems of the prior art. The instant torpedo tube and slide valve assembly comprises a torpedo tube having a cylindrical outer surface and a plurality of circumferentially spaced slots therein. An impulse tank surrounds the torpedo tube wherein the slots provide a flow path between the impulse tank and the interior of the torpedo tube. A cylindrical slide valve concentric with the torpedo tube is received around the outside of the torpedo tube but inside the impulse tank. The inner surface of the slide valve is received in closely spaced sliding relation with the outer surface of the torpedo tube. The slide valve is slidably movable inside the impulse tank between a first position wherein the slide valve covers the slots and a second position wherein the slots are uncovered. The impulse tank includes a sleeve portion concentric with the torpedo tube which extends in a breechward direction to accommodate sliding movement of the slide valve. Rubber sealing gaskets are provided on the outer surface of the torpedo tube at each end of the flow slots for providing spaced circumferential seals between the torpedo tube outer surface and the inner surface of the slide valve. Positioning of the slide valve on the outside of the torpedo tube increases flow area through the flow slots, eliminates the need to provide a guide slot in the slide valve, and permits the internal lands of the torpedo tube to extend for substantially the entire length of the torpedo tube.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
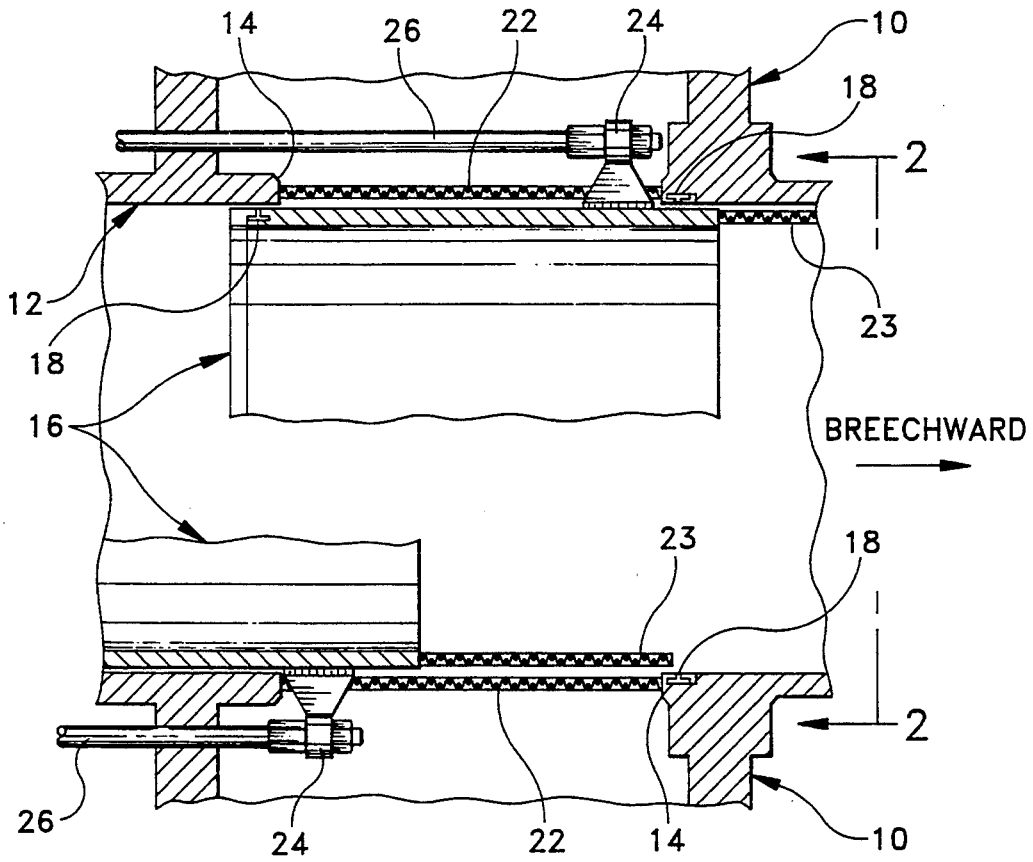
FIG. 1 (PRIOR ART)
FIG. 1 is a cross-sectional view of a prior art torpedo tube slide valve.
Figure 2:
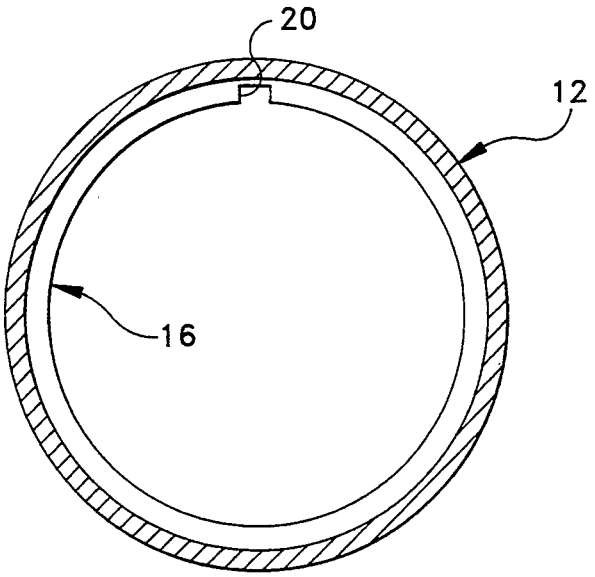
FIG. 2 (PRIOR ART)
FIG. 2 is a cross-sectional view thereof taken along line 2—2 of FIG. 1.
Figure 3:
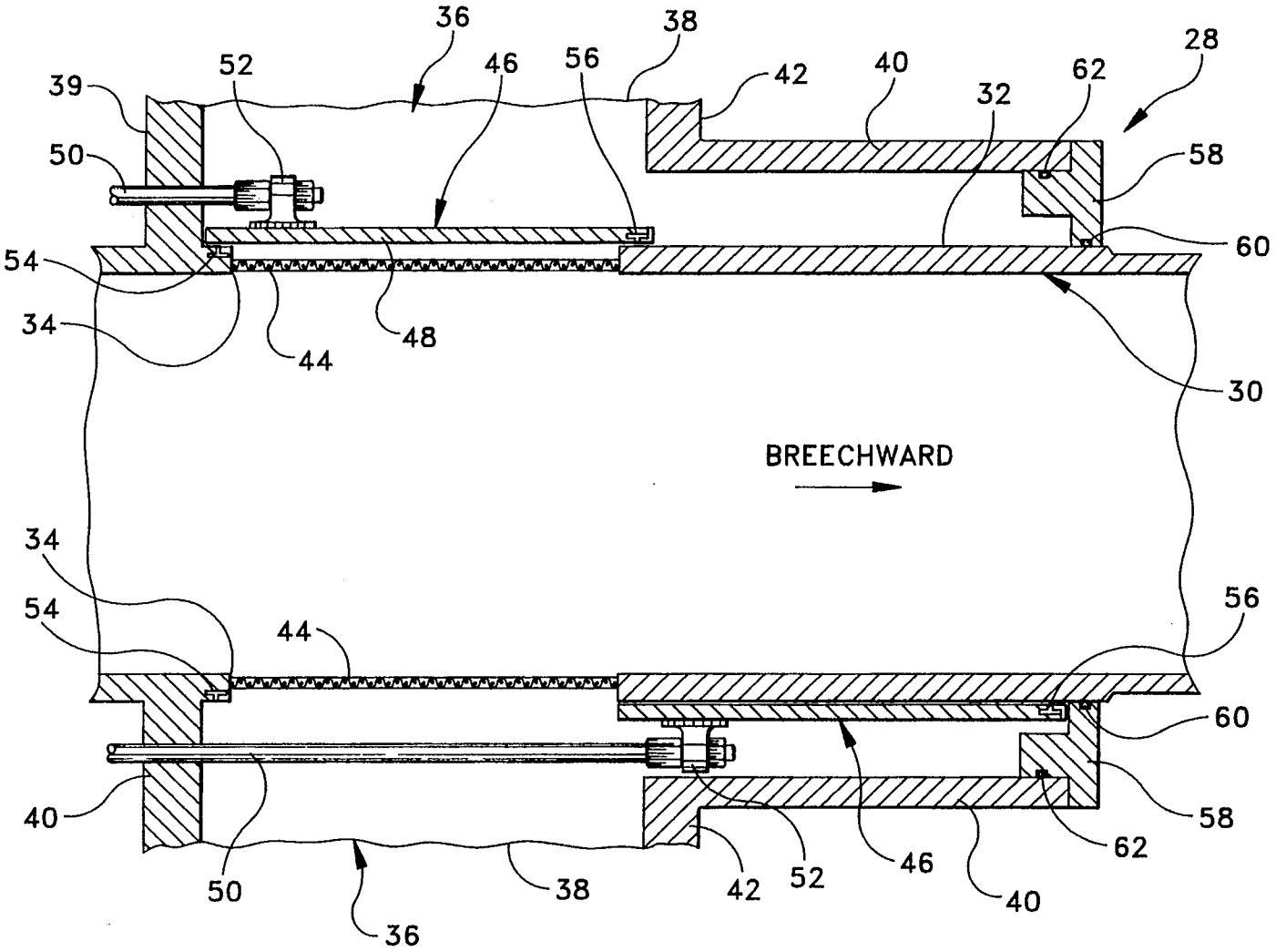
FIG. 3 is a cross-sectional view of the torpedo tube slide valve of the instant invention.

Referring now to the drawings, the torpedo tube and slide valve assembly of the instant invention is illustrated and generally indicated at 28 in FIG. 3. Torpedo tube and slide valve assembly 28 comprises a torpedo tube generally indicated at 30 having a cylindrical outer surface 32 and a plurality of longitudinally extending, circumferentially spaced slots 34. An impulse tank generally indicated at 36 surrounds the breech end of torpedo tube 30 wherein slots 34 provide a flow path between impulse tank 36 and the interior of torpedo tube 30. Impulse tank 36 includes a main body portion 38 which surrounds the slotted portion of torpedo tube 30. The outer wall 39 of the impulse tank 36 is welded to outer surface 32 of torpedo tube 30. Impulse tank 36 further includes a cylindrical sleeve portion 40 depending from an inner wall 42 thereof which extends concentrically with torpedo tube 30 in a breechward direction in radially spaced relation to outer surface 32 of torpedo tube 30. Each slot 34 in torpedo tube 30 is provided with a screen or grate 44 which prevents a communication or guidance cable from a launched weapon from falling into impulse tank 36 and becoming tangled.

Assembly 28 further comprises an external cylindrical slide valve generally indicated at 46 concentric with torpedo tube 30 and contained within impulse tank 36. Slide valve 46 has an inner surface 48 which is received in closely spaced sliding relation with outer surface 32 of torpedo tube 30. In this connection, both inner surface 48 of slide valve 46 and outer surface 32 of torpedo tube 30 are machined to provide close tolerances. Slide valve 46 is slidably movable inside impulse tank 36 between a first normal position (upper half of FIG. 3) wherein slide valve 46 covers slots 34, and a second breechward position (lower half of FIG. 3) wherein slots 34 are uncovered. Slide valve 46 is actuated by means of power cylinder rods 50 which extend through outer wall 39 of impulse tank 36. Power cylinder rods 50 are connected to slide valve 46 by brackets 52. Positioning and operation of power cylinders 50 are conventional in the art, and therefore no further description is believed to be necessary. When slide valve 46 is in the first position, it is generally positioned within the main body 38 of impulse tank 36, however, when it is moved to the second position, it resides in breechward sleeve portion 40 of impulse tank 36. A first gasket 54 is mounted on outer surface 32 of torpedo tube 30 adjacent outer wall 39 of impulse tank 36. A second gasket 56 is mounted to inner surface 48 of slide valve 46 at its breechward end. When slide valve 46 is in the first position, gaskets 54 and 56 provide a water tight seal between inside surface 48 of slide valve 46 and outer surface 32 of torpedo tube 30 at each end of slots 34 to prevent water from impulse tank 36 from entering torpedo tube 30.

An annular end cap 58 is received around the breechward end of torpedo tube 30 and is removably mounted by any suitable means to the breechward end of impulse tank sleeve portion 40. End cap 58 includes sealing means for forming a seal between the breechward end of impulse tank sleeve portion 40 and outer surface 32 of torpedo tube 30. The sealing means preferably comprises a first O-ring 60 received between end cap 58 and outer surface 32 of torpedo tube 30 and a second O-ring 62 which is received between end cap 58 and sleeve portion 40 of impulse tank 36. End cap 58 permits the removal of slide valve 46 at a breechward end of torpedo tube 30 in the event that gasket 56 needs to be replaced or if slide valve 46 is damaged. Gasket 54 can be replaced through slots 34 from within torpedo tube 30.

Figure 4:
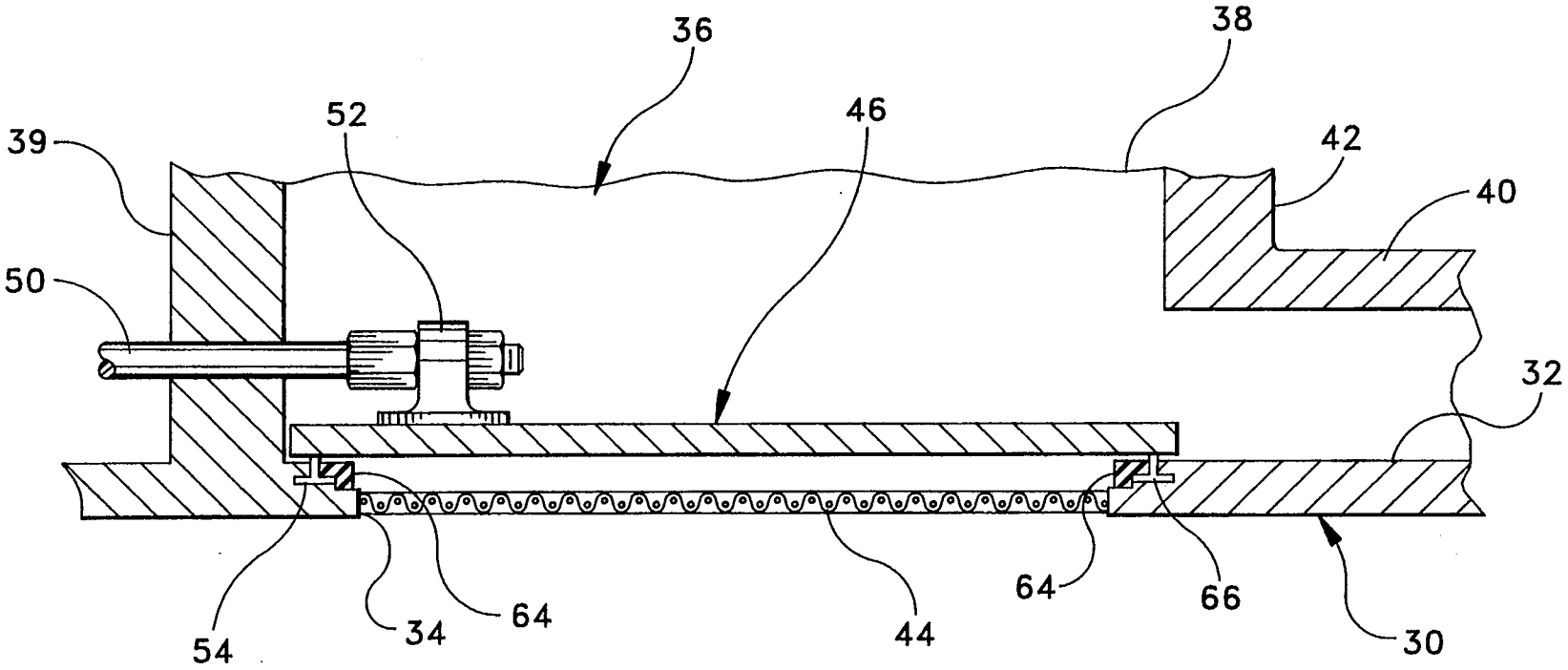
FIG. 4 is a cross-sectional view of an alternate gasket arrangement.

Referring now to FIG. 4 an alternative mounting arrangement of the sealing gaskets is illustrated. In this particular arrangement, both gaskets are mounted to outer surface 32 of torpedo tube 30 by means of removable gasket retainers 64. Gasket 54 is mounted to outer surface 32 of torpedo tube 30 adjacent outer wall 39 of impulse tank 36 as in the first embodiment; however, gasket 54 is retained in position by means of removable gasket retainer 64. A second gasket 66 is mounted to outer surface 32 of torpedo tube 30 adjacent inner wall 42 of impulse tank 36. Gaskets 54 and 66 provide a circumferential water tight seal at each end of flow slots 34. This arrangement allows gaskets 54 and 66 to be replaced through slots 34 without having to remove slide valve 46 from its normal operating position. This arrangement does however require impulse tank sleeve portion 40 to be extended somewhat in order to allow extended movement of slide valve 46 breechward of the breechward seal 66.

It can therefore be seen that the instant invention provides a unique and novel torpedo tube slide valve assembly 28 which overcomes the problems associated with the prior art slide valve assemblies. By positioning slide valve 46 externally of torpedo tube 30, the flow area is significantly increased. In addition, there is no longer any need to provide a guide slot in slide valve 46 thereby increasing the structural integrity of the slide valve structure. Furthermore, the internal lands of the torpedo tube can now extend the entire length of torpedo tube 30. This allows the guide slot on the upper vertical centerline to also extend for the entire length of the torpedo tube. Accordingly, all rifling of a weapon in the tube may be eliminated. For these reasons, the torpedo tube slide valve of the instant invention is believed to represent a significant improvement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A torpedo tube and slide valve assembly comprising:

a torpedo tube having a cylindrical outer surface and a plurality of circumferentially spaced slots therein;

an impulse tank surrounding said torpedo tube wherein said slots provide a flow path between the impulse tank and the interior of the torpedo tube;

a cylindrical slide valve concentric with said torpedo tube and positioned inside said impulse tank, said slide valve having an inner surface in closely spaced sliding relation with the outer surface of said torpedo tube, said slide valve being slidably movable inside said impulse tank between a first position wherein said slide valve covers said slots and a second position wherein said slots are uncovered;

means for actuating said slide valve between said first and second positions; and sealing means for providing spaced circumferential seals between said torpedo tube outer surface and said slide valve inner surface.

2. In the torpedo tube and slide valve assembly of claim 1, said impulse tank having a main body portion surrounding said plurality of circumferentially spaced slots of said torpedo tube, said impulse tank further including a cylindrical sleeve portion depending from said main body portion which extends concentrically with said torpedo tube in a breechward direction in radially spaced relation to the outer surface of said torpedo tube wherein said slide valve is positioned in said main body portion of said impulse tank when in said first position and is further positioned in said sleeve portion of said impulse tank when in said second position.

3. The torpedo tube and slide valve assembly of claim 2, further comprising an annular end cap which is received around said torpedo tube and removably mounted to the breechward end of the impulse tank sleeve portion, said annular end cap including sealing means for forming a seal between the breechward end of the impulse tank sleeve portion and the outer surface of the torpedo tube.

4. In the torpedo tube and slide valve assembly of claim 1, said sealing means comprising first and second circumferentially spaced gaskets.

5. In the torpedo tube and slide valve assembly of claim 4, said spaced gaskets being removably secured to the outside surface of said torpedo tube.

6. A slide valve assembly comprising:

a cylindrical tube having an outer surface and a plurality of circumferentially spaced slots therein;

a cylindrical slide valve concentric with said tube and having an inner surface which is in closely spaced sliding relation with said outer surface of said tube, said slide valve being slidably movable between a first position wherein said slide valve covers said slots and a second position wherein said slots are uncovered;

means for actuating said slide valve between said first and second positions;

sealing means for providing spaced circumferential seals between said outer surface of said tube and said slide valve inner surface at first and second ends of said slots; and an impulse tank surrounding said tube wherein said slots provide a flow path between said impulse tank and the interior of said tube.

7. In the slide valve assembly of claim 6, said impulse tank having a main body portion surrounding said plurality of circumferentially spaced slots of said tube and a cylindrical sleeve portion depending from said main body portion which extends concentrically with said tube in an axial direction in radically spaced relation to the outer surface of said tube wherein said slide valve is positioned in said main body portion of said impulse tank when in said first position and is positioned in said sleeve portion of said impulse tank when in said second position.

* * * * *